US006164425A

United States Patent [19]

Latshaw

[11] Patent Number: 6,164,425

[45] Date of Patent: Dec. 26, 2000

[54] LARGE RECREATIONAL EQUIPMENT LUGGAGE TRANSPORT SYSTEM AND METHOD OF TRANSPORTING SAME

[75] Inventor: Ricky J. Latshaw, Atlanta, Ga.

[73] Assignee: Seven Oars, Inc., Republic, Mo.

[21] Appl. No.: 09/205,594

[22] Filed: Dec. 4, 1998

[51] Int. Cl.[7] ..... A45C 5/00

[52] U.S. Cl. ..... 190/18 A; 190/108; 190/127; 206/315.1; 206/315.3; 280/47.24; 280/47.26; 280/43.1

[58] Field of Search ..... 280/641, 67, 652, 280/47.24, 47.26, 43.1; 190/18 A, 108, 124, 127; 206/315.1, 315.2, 315.5, 315.3

[56] References Cited

U.S. PATENT DOCUMENTS

| | | | |
|---|---|---|---|
| D. 333,038 | 2/1993 | Collins | D3/36 |
| D. 360,296 | 7/1995 | Hunsaker | D3/255 |
| 2,539,993 | 1/1951 | Davis | 190/18 A |
| 3,064,990 | 11/1962 | Salvucci | 280/47 |
| 3,850,441 | 11/1974 | Peters et al. | 280/47 |
| 4,063,581 | 12/1977 | Williams | 190/18 A |
| 4,263,950 | 4/1981 | Brown | 206/315.4 |
| 4,284,286 | 8/1981 | Lewallen | 280/30 |
| 4,630,837 | 12/1986 | Kazmark | 280/47 |
| 4,681,330 | 7/1987 | Misawa | 280/47 |
| 4,822,070 | 4/1989 | Korona et al. | 280/47 |
| 5,160,153 | 11/1992 | Zan | 280/43.1 |
| 5,207,439 | 5/1993 | Mortenson | 280/47 |
| 5,240,106 | 8/1993 | Plath . | |
| 5,273,298 | 12/1993 | Brown, Sr. | 206/315.1 |
| 5,295,565 | 3/1994 | Latshaw | 190/18 |
| 5,306,027 | 4/1994 | Cheng | 280/655 |
| 5,445,399 | 8/1995 | Salvucci, Sr. | 280/47 |
| 5,515,897 | 5/1996 | Fehan | 206/315.3 |
| 5,519,919 | 5/1996 | Lee | 16/115 |
| 5,568,848 | 10/1996 | Liang | 190/18 |
| 5,570,764 | 11/1996 | Levin . | |
| 5,758,752 | 6/1998 | King et al. | 190/18 |
| 5,799,251 | 7/1998 | Meier | 280/47 |
| 5,873,439 | 2/1999 | Liang | 190/18 A |
| 5,927,361 | 7/1999 | Sanderson et al. | 150/159 |
| 5,984,326 | 11/1999 | Abraham et al. | 190/18 A |

FOREIGN PATENT DOCUMENTS

| | | |
|---|---|---|
| 0210953 | 2/1987 | European Pat. Off. . |
| 8900902 | 9/1989 | Germany . |
| 10304921 | 11/1998 | Japan . |
| 97/48304 | 12/1997 | WIPO . |

*Primary Examiner*—Stephen P. Garbe
*Assistant Examiner*—Tri M. Mai
*Attorney, Agent, or Firm*—Allen, Dyer, Doppelt, Milbrath & Gilchrist, P.A.

[57] ABSTRACT

A recreational equipment luggage transport system, an auxiliary transport apparatus, and methods for transporting recreational equipment are provided. The system preferably includes an enlarged main piece of recreational equipment storage luggage having enlarged recreational equipment positioned therein. The enlarged recreational equipment, for example, preferably has a longitudinal extent substantially longer than a standard adult size tennis racket. The main piece of luggage includes a main luggage frame, at least one wheel member connected to a lower end portion of the main luggage frame, a cover connected to the main luggage frame and sized to position large recreational equipment therein, and an auxiliary transport apparatus pivotally connected to the main luggage frame. The auxiliary transport apparatus is positioned to be pivotally extended to a first engaged position and pivotally retracted to a second different storage position and includes an auxiliary frame and a plurality of auxiliary wheel members connected thereto. At least one piece of additional luggage is connected to the cover of the enlarged main piece of recreational equipment storage luggage.

68 Claims, 8 Drawing Sheets

10
43
20
43
40
45
20
43
50
55
42
32
71
59
53
52

10
G
43
30b
29
46
G
40
43
20
45
30a 10
30
43
45
43
82
81
43
40
50
55
52
53
71
32
42

10
43
40
42
88
42
43
84
85
87
86
82
89
81

LARGE RECREATIONAL EQUIPMENT LUGGAGE TRANSPORT SYSTEM AND METHOD OF TRANSPORTING SAME

FIELD OF THE INVENTION

This invention is related to the luggage industry and, more particularly, to a system and methods for transporting luggage.

BACKGROUND OF THE INVENTION

Numerous luggage transporting problems have arisen over the years for transporting luggage in airports, hotels, various vehicle, and various marshaling areas for luggage. One of the more popular types of luggage that has been developed is the so-called "wheeled luggage" which has one or more wheels connected to a peripheral edge of a lower end of a piece of luggage and an extendable and retractable handle positioned on a peripheral edge of an upper end of the luggage. A person transporting the luggage can then readily tilt the luggage upon the wheels when positioned upon a support surface and tow the luggage with the extended handle. When transporting the luggage by hand is not a concern, the handle can be retracted and the luggage lifted by one or more auxiliary handles to store the luggage. This type of wheeled luggage is commonly known for carrying clothes and is generally compact for fitting underneath seats and in overhead luggage compartments on airplanes. An example of such wheeled luggage can be seen in U.S. Pat. No. 5,295,565 by Latshaw titled "Wheeled Luggage" which also has the common inventor as the present patent application.

Using wheels on luggage for larger, and often heavier, recreational equipment such as golf bags, skis, camping equipment, surfboards, and musical instruments is less known. Such large recreational equipment does not typically fit into conventional luggage sized to carry clothing or conventional wheeled luggage as illustrated in the patent cited above. When such enlarged luggage is transported to a destination, the user often has to manually lift, drag, or haul the equipment without the use of wheels or in addition to carrying or towing other luggage. Alternatively, the user may position the enlarged luggage or equipment on an airport luggage dolly or cart, but the enlarged luggage or equipment protrudes from the dolly or cart still making it awkward and difficult to transport. Other hand trucks or dollies have been developed which are collapsible for travel and the like. An example of one of these hand trucks can be seen in U.S. Pat. No. 4,630,837 by Kazmark titled "Two-Wheeled Cart With Auxiliary Wheel." To pack and transport such collapsible dollies can be difficult and awkward. Additionally, such hand trucks are conventionally sized for smaller items or smaller luggage and not larger recreational equipment.

Also, porters or other personnel often are hired or needed to carry a person's enlarged luggage, especially when additional luggage also needs to be transported for a trip. The transporter of the enlarged luggage still can often easily tilt, drop, or generally lose control of the handling of the luggage. Such transporting of the enlarged luggage can be made even more difficult when the transporter also has to handle other pieces of luggage such as for clothing, laptop computers, brief cases, tote bags, or other luggage associated with the person's travel. Further, such hiring of additional personnel can be expensive, especially for a frequent traveler, and sometimes this type of help is not available such as in some hotel lobbies, airports, or other marshaling areas.

SUMMARY OF THE INVENTION

In view of the foregoing, the present invention advantageously provides a balanced and efficient recreational equipment luggage transport system, an auxiliary transport apparatus and methods of transporting various types of recreational equipment which eases the handling and transporting of recreational equipment. The present invention also advantageously provides a recreational equipment luggage transport system which makes travel with enlarged recreational equipment less worrisome, less problematic, and handled in a more controlled manner. The present invention additionally advantageously provides a luggage transport system and methods of transporting luggage which reduces time in transporting various luggage by compactly and systematically being able to handle a plurality of pieces of luggage, including even luggage which stores enlarged recreational equipment. The present invention further advantageously provides a luggage transport system, auxiliary transport apparatus, and methods of transporting luggage which can reduce the expense and need to hire additional personnel to handle a plurality of pieces of luggage.

More particularly, a recreational equipment luggage transport system of the present invention preferably includes an enlarged main piece of recreational equipment storage luggage having enlarged recreational equipment positioned therein. The enlarged recreational equipment, for example, preferably has a longitudinal extent substantially longer than a standard adult size tennis racket. The main piece of luggage includes a main luggage frame, at least one wheel member connected to a lower end portion of the main luggage frame, a cover connected to the main luggage frame and sized to position large recreational equipment therein, and an auxiliary transport apparatus pivotally connected to the main luggage frame. The auxiliary transport apparatus is positioned to be extended to a first engaged position and retracted to a second different storage position and includes an auxiliary frame and a plurality of auxiliary wheel members connected thereto. At least one piece of additional luggage is connected to the cover of the enlarged main piece of recreational equipment storage luggage.

According to another aspect of the present invention, a recreational equipment luggage transport system for transporting recreational equipment can advantageously include a main piece of recreational equipment storage luggage having a main luggage frame which includes at least a lower base frame member, an upper frame member, and a pair of spaced-apart and substantially parallel tubular members interconnecting the upper frame member and the lower base frame member and maintaining the upper frame member and the lower base member in a predetermined spaced-apart relation so as to define a main body cavity therebetween for positioning recreational equipment therein. The main piece of luggage also preferably has at least one wheel member connected to a rearwardly extending portion of the lower base frame member, at least one foot member extending downwardly from a forwardly extending portion of the lower base frame member, and a cover connected to the upper frame member and the lower base member and enclosing the main body cavity. The cover preferably has an openable fastener thereon for providing access to the interior of the main body cavity. The main piece of luggage also preferably has an auxiliary transport apparatus pivotally connected to the main luggage frame. The auxiliary transport apparatus is positioned to be extended to a first engaged position and retracted to a second different storage position and includes an auxiliary frame and a plurality of auxiliary wheel members connected thereto. The system also has a plurality of pieces of additional luggage connected to the cover of the main piece of recreational equipment storage luggage. The cover and each of the plurality of additional pieces of luggage include a plurality of mating fasteners connected thereto. At least one mating fastener portion of the plurality of mating fasteners is connected to the cover on an opposite surface of the cover from a surface of the cover from which said auxiliary transport apparatus extends. The opposite surface preferably defines a front surface and the surface from which the auxiliary transport apparatus extends defines a rear surface. At least one of the additional pieces of luggage is matingly fastened to the at least one mating fastener portion of the cover to thereby supportingly carry and transport the at least one piece of additional luggage with the enlarged main piece of luggage connected thereto.

According to yet another aspect of the present invention, a luggage transport system preferably includes a main piece of luggage having a main luggage frame. The main luggage frame has a pair of spaced-apart and substantially parallel tubular members interconnecting upper and lower portions of the main luggage frame, at least one wheel member connected to a lower end portion of the main luggage frame, a cover connected to the frame, and an auxiliary transport apparatus pivotally connected to the main luggage frame. The auxiliary transport apparatus is positioned to be extended to a first engaged position and retracted to a second different storage position and includes an auxiliary frame, a plurality of auxiliary wheel members connected thereto, and an auxiliary cover member connected to and extending outwardly from a lower rearward portion of the cover of the main piece of luggage and connected to the auxiliary frame so that when the auxiliary transport apparatus is positioned in the retracted storage position the auxiliary frame is substantially hidden from ready viewing by the auxiliary cover member.

The present invention also advantageously provides an auxiliary transport apparatus for providing a balanced transport system to a wheeled device. The apparatus preferably has an auxiliary frame positioned to be connected to a frame of the wheeled device. The auxiliary frame preferably includes an auxiliary frame facing member positioned to be pivotally connected to the frame of the wheeled device and to extend outwardly therefrom and at least one pair of spaced-apart auxiliary frame arms positioned to be connected to the frame of the wheeled device and the auxiliary frame facing member and being movably positioned between a retracted storage position and an extended engaged position. Each arm of the at least one pair of spaced-apart auxiliary frame arms includes a first arm portion connected to the auxiliary frame facing member and extending inwardly therefrom, a second arm portion positioned to be connected to the frame of the wheeled device and extend outwardly therefrom and pivotally connected to the first arm portion, and at least one arm lock portion associated with the first and second arm portions for engagingly retaining the first and second arm portions in the extended engaged position. The auxiliary frame facing member preferably has a substantially rectangular shape and includes upper and lower spaced-apart elongate frame portions longitudinally extending substantially parallel to each other and a pair of spaced-apart elongate side frame portions each transversely connected to the upper and lower spaced-apart elongate frame portions and extending substantially parallel to each other. A respective one of each of the at least one pair of spaced-apart auxiliary frame arms is connected to a medial portion of a respective one of the pair of spaced-apart elongate side frame portions. The apparatus also has a plurality of auxiliary wheel members connected to a lower end portion of the auxiliary frame.

The present invention preferably also includes a method of transporting large recreational equipment. The method preferably includes the step of positioning large recreational equipment within a main storage body cavity of an enlarged main piece of recreational equipment storage luggage. The main piece of luggage has a main luggage frame positioned along a rearward end thereof and has at least one wheel member connected to a lower end portion of the main luggage frame. The method also preferably includes the step of extending an auxiliary transport apparatus outwardly from the main luggage frame. The auxiliary transport apparatus includes an auxiliary frame and at least one auxiliary wheel member connected to the auxiliary frame. The method further includes the step of towing the main piece of luggage so that the at least one wheel member thereof and the at least one auxiliary wheel member abuttingly contact the same support surface when being towed.

BRIEF DESCRIPTION OF THE DRAWINGS

Some of the features, advantages, and benefits of the present invention having been stated, others will become apparent as the description proceeds when taken in conjunction with the accompanying drawings in which.

DETAILED DESCRIPTION OF PREFERRED EMBODIMENTS

Figure 1:
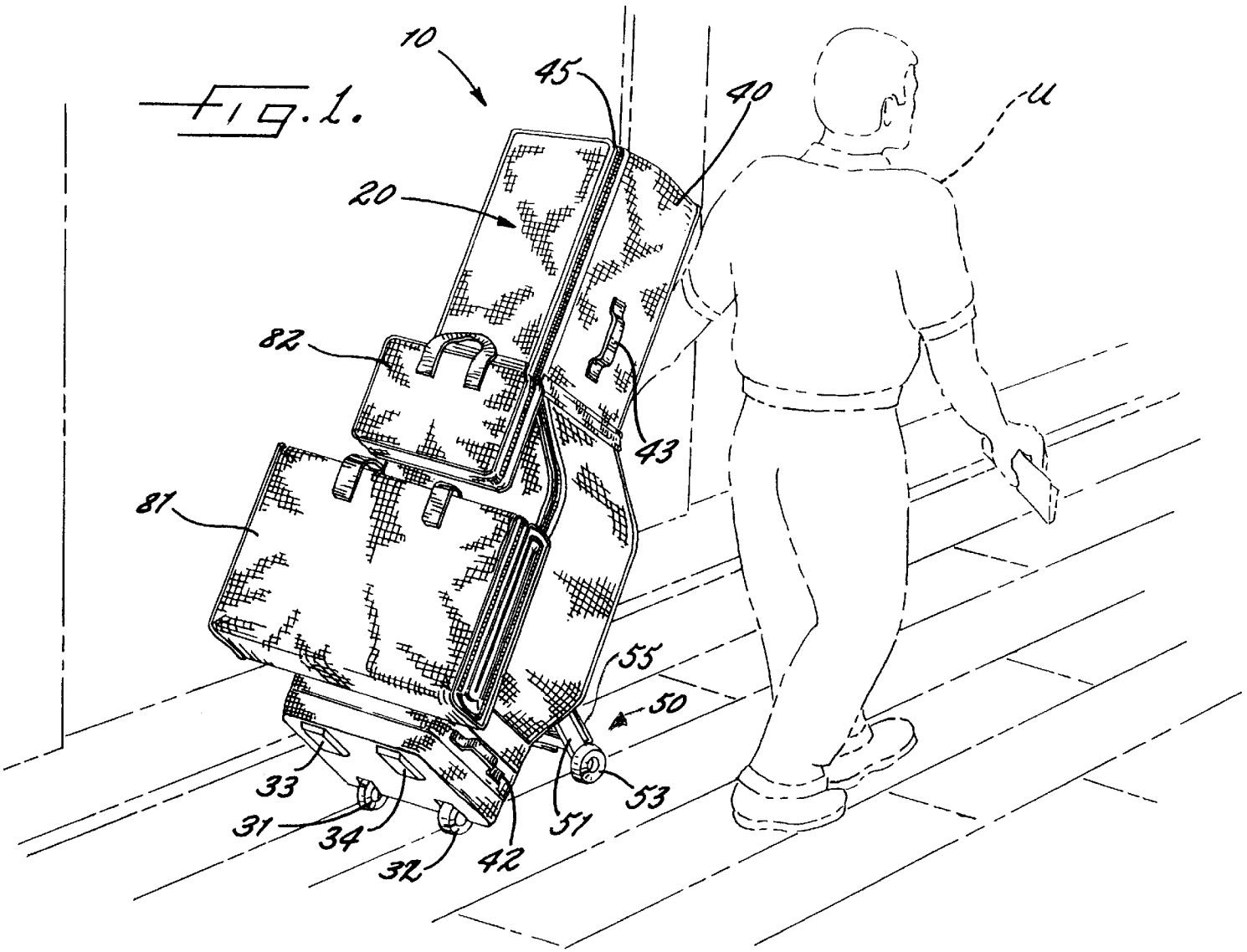
FIG. 1 is an environmental view of a recreational equipment luggage transport system according to the present invention.

The present invention will now be described more fully hereinafter with reference to the accompanying drawings, in which preferred embodiments of the invention are shown. This invention may, however, be embodied in many different forms and should not be construed as limited to the illustrated embodiments set forth herein. Rather, these illustrated embodiments are provided so that this disclosure will be thorough and complete, and will fully convey the scope of the invention to those skilled in the art. Like numbers refer to like elements throughout, and prime and double prime notation, if used, indicate similar elements in alternative embodiments.

FIGS. 1–8 illustrate a first embodiment of a recreational equipment luggage transport system 10 according to the present invention. The recreational equipment luggage transport system 10 is advantageously used for transporting large recreational equipment such as golf bags G, snow and water skis S, camping equipment, surfboards, musical instruments, or other large recreational equipment. The large recreational equipment, for example, can be defined as having a longitudinal extent substantially longer than a standard adult tennis racket, e.g., substantially longer than about 30 inches. In other words, the large recreational equipment of concern would not typically fit into a standard piece of clothing luggage or wheeled luggage for clothing.

The system preferably includes a main piece 20 of recreational equipment storage luggage having a main luggage frame 21 which includes at least a lower base frame member 22, an upper frame member 25, and a pair of spaced-apart and substantially parallel tubular members 27, 28 interconnecting the upper frame member 25 and the lower base frame member 22. The tubular members 27, 28 also advantageously maintain the upper frame member 25 and the lower base member 22 in a predetermined spaced-apart relation so as to define a main body cavity 29 there between for positioning large recreational equipment therein. The main piece of luggage 20 also preferably has at least one wheel member, and preferably a pair of wheeled members 31, 32 as best illustrated in FIGS. 1, 3, and 7–8, connected to a rearwardly extending portion of the lower base frame member 22. In addition, at least one foot member, and preferably feet 33, 34, extends downwardly from a forwardly extending portion of the lower base frame member 22. The lower base frame member 22 preferably includes a first plate portion 23 extending substantially parallel to a support surface when the at least one foot member 33, 34 and the at least one wheel member 31, 32 abuttingly contact the support surface and a second plate portion 24 connected to the first plate portion 23 along a common edge thereof and extending upwardly therefrom so as to define a substantially L-shape plate member. The upper frame member 25 preferably has a substantially rectangular shape with rounded corners, as illustrated.

Figure 8:
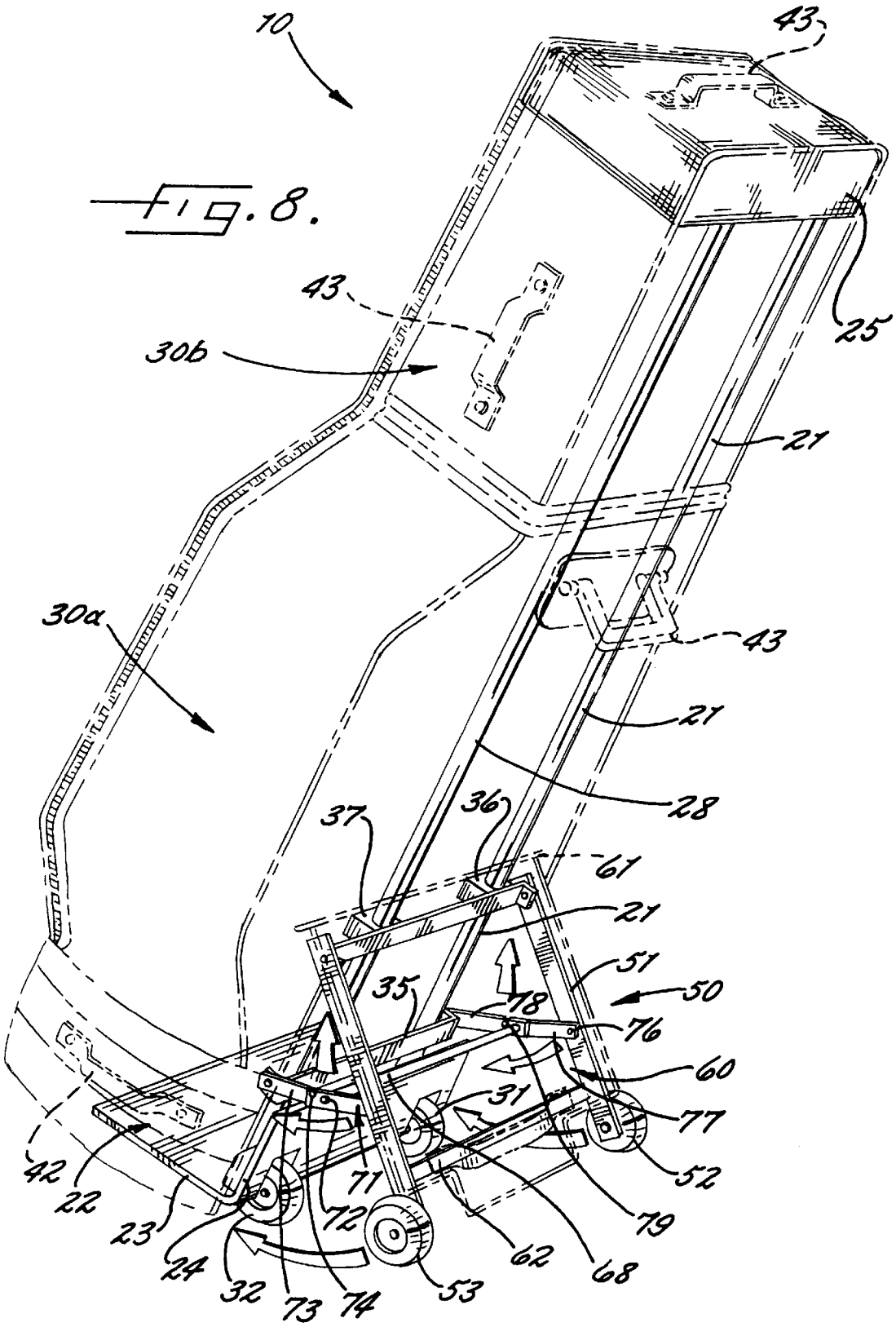
FIG. 8 is a rear perspective view of a main luggage frame having a cover shown in dashed lines of a recreational equipment luggage transport system according to the present invention.

The main luggage frame 21 further preferably includes tubular member engaging means connected to the pair of spaced-apart tubular members 27, 28 and connected to an auxiliary frame 51 of an auxiliary transport apparatus 50 for supportingly engaging the pair of tubular members 27, 28. The tubular member engaging means is preferably provided by a pair of frame mounts 36, 37 each having a mount body and an annular shaped opening extending therethrough as illustrated in FIG. 8. The annular shaped opening is positioned to receive one of the pair of tubular members 27, 28 therethrough. The tubular member engaging means can also advantageously be slidable along the tubular members 27, 28 for providing an adjustable balance for the transport system 10 depending on what a user U is storing and transporting. This can advantageously allow the user U to select the balanced position of the location of the auxiliary transport apparatus 50 which is easiest for his or her personal transporting needs and/or desires. The main luggage frame 21 also preferably includes a lower auxiliary frame mounting member 35 transversely connected to lower portions of the pair of tubular members 27, 28 (see FIG. 8).

A cover 40 is preferably connected to the upper frame member 25 and the lower base member 22 and encloses the main body cavity 29 where the large recreational equipment will be positioned or stored. The cover 40 preferably has at least one openable fastener 45 thereon for providing access to the interior of the main body cavity 29 (see FIGS. 3–4 and 9). The main piece 20 of recreational equipment storage luggage can advantageously be shaped to easily receive an adult size set of golf clubs G (e.g., as approved by the standards of the U.S.G.A.) positioned in an adult size golf bag (see FIG. 4) or, in an alternative embodiment, can advantageously be shaped to easily receive at least one pair, and preferably a plurality of pairs, of adult size skis S (e.g., as approved by the U.S. Ski Association or Federation), e.g., snow skis or water skis. The cover 40 is preferably openable by the openable fastener 45, e.g., preferably provided by a zipper, along a front portion of the cover 40. The openable fastener 45 extends along at least two of the peripheral edges of the front cover and preferably extends along three peripheral edges thereof. The cover 40 also has at least one lifting handle 42 connected thereto and overlying a lower portion of the main body cavity 29, e.g., near, on, or adjacent the lower base frame member 22.

The main storage body cavity 29 of the main piece 20 of recreational equipment storage luggage preferably includes a first lower portion 30*a* extending along a lower portion of the main luggage frame 21 and a second upper portion 30*b* contiguous with or coextensive to the first lower portion 30*a* and extending along an upper portion of the main luggage frame 21. The first lower portion 30*a* is preferably substantially larger than the second upper portion 30*b* to receive a substantially larger portion of the mass positioned in said main body cavity 29. For example, golf bags G often have a portion which carries golf clubs and an additional enlarged pocket or cavity for carrying golf balls, shoes, umbrellas, jackets, or other desired items associated with the playing of golf (see FIG. 4). Likewise, in addition to skis S and poles, skiers often need to carry boots, jackets, thermally enhanced undergarments, helmets or hats, various eye gear, or other desired items associated with skiing (see FIG. 9). Accordingly, the larger lower portion can be one or more areas where the traveler can store these items, be positioned to have a lower center of gravity, and be easily stored in addition to the longer longitudinal extent of the larger recreational equipment itself. The auxiliary transport apparatus 50 is preferably connected to the lower portion of the main luggage frame 21 for enhancing stability of transporting the system 10 having a substantially larger portion of the mass positioned in the main storage body cavity 29.

Figure 7:
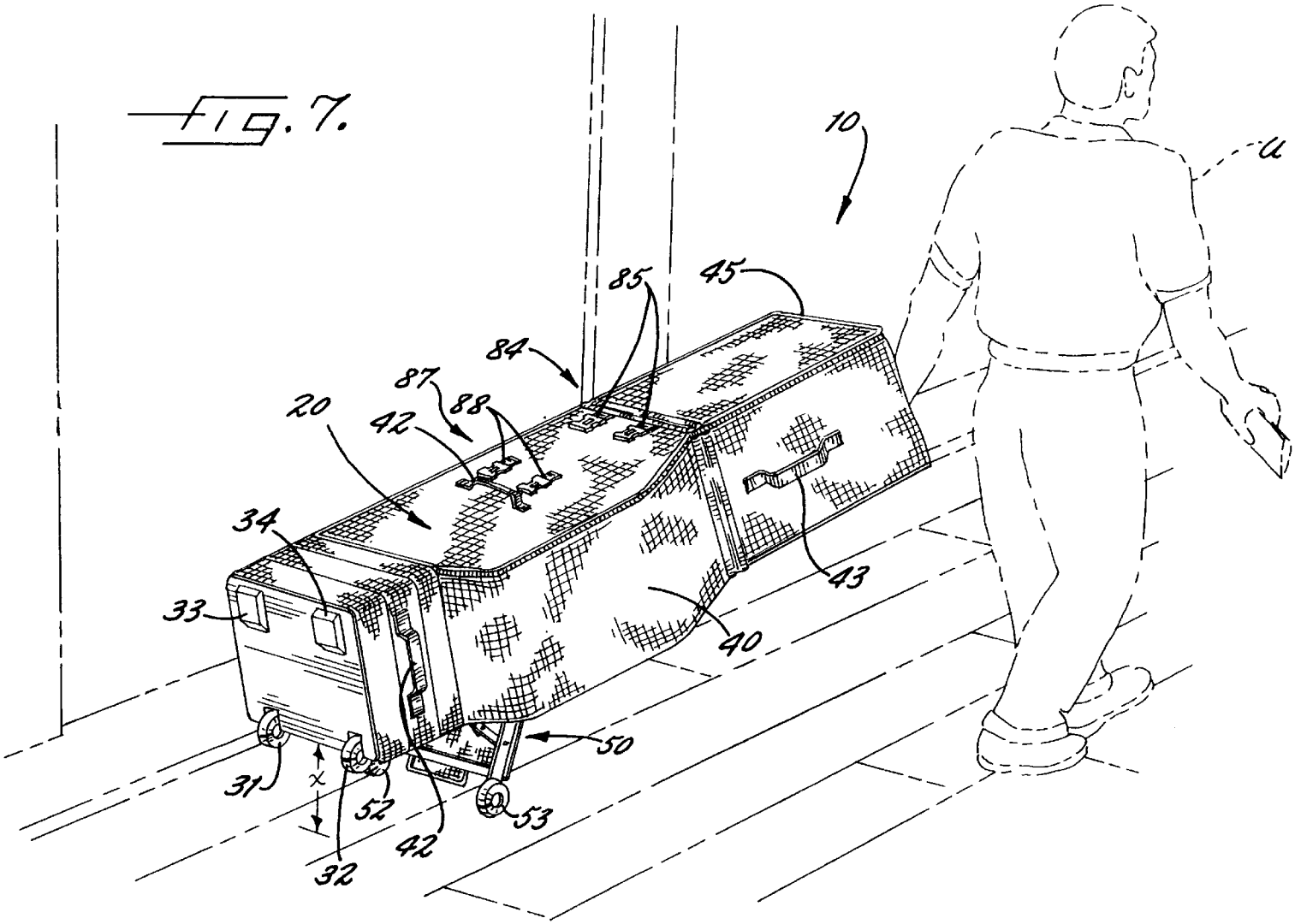
FIG. 7 is an environmental view of a recreational equipment luggage transport system showing the towing thereof from a top handle according to the present invention.

As perhaps best illustrated in FIGS. 1–3, 5, and 7, the cover 40 of the main piece of recreational equipment storage luggage 20 has at least one tow handle 43, and preferably a plurality of tow handles 43, connected to an upper portion thereof to enhance towing of the system 10 when the auxiliary transport apparatus 50, as described in more detail below herein, is positioned in the extended and engaged position. More preferably, the cover 40 includes a plurality of tow handles 42, 43 in various positions as illustrated. Two readily balanced positions of towing by the fixed tow handle 43, however, are by the rear of the main piece 20 of luggage as illustrated in FIG. 1 and by the top of the main piece 20 of luggage as illustrated in FIG. 7. Noticeably by the use of the top handle 43, only the auxiliary wheels 52, 53 advantageously need to be used to contact the support surface. The main wheel members 31, 32 are spaced from the support surface a distance X as indicated.

Figure 2:
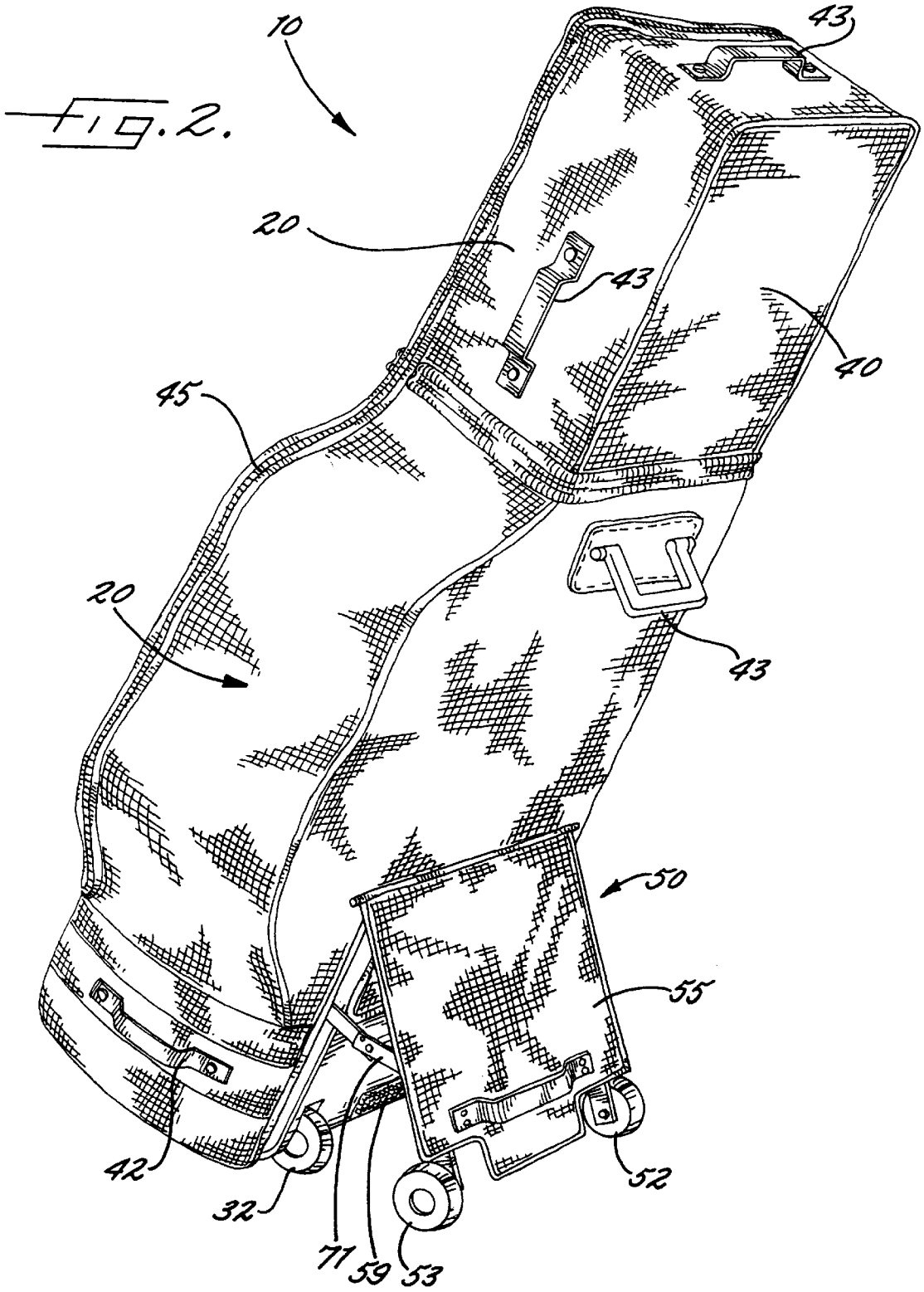
FIG. 2 is a rear perspective view of a recreational equipment luggage transport system having an auxiliary transport apparatus shown in an extended position according to the present invention.
Figure 3:
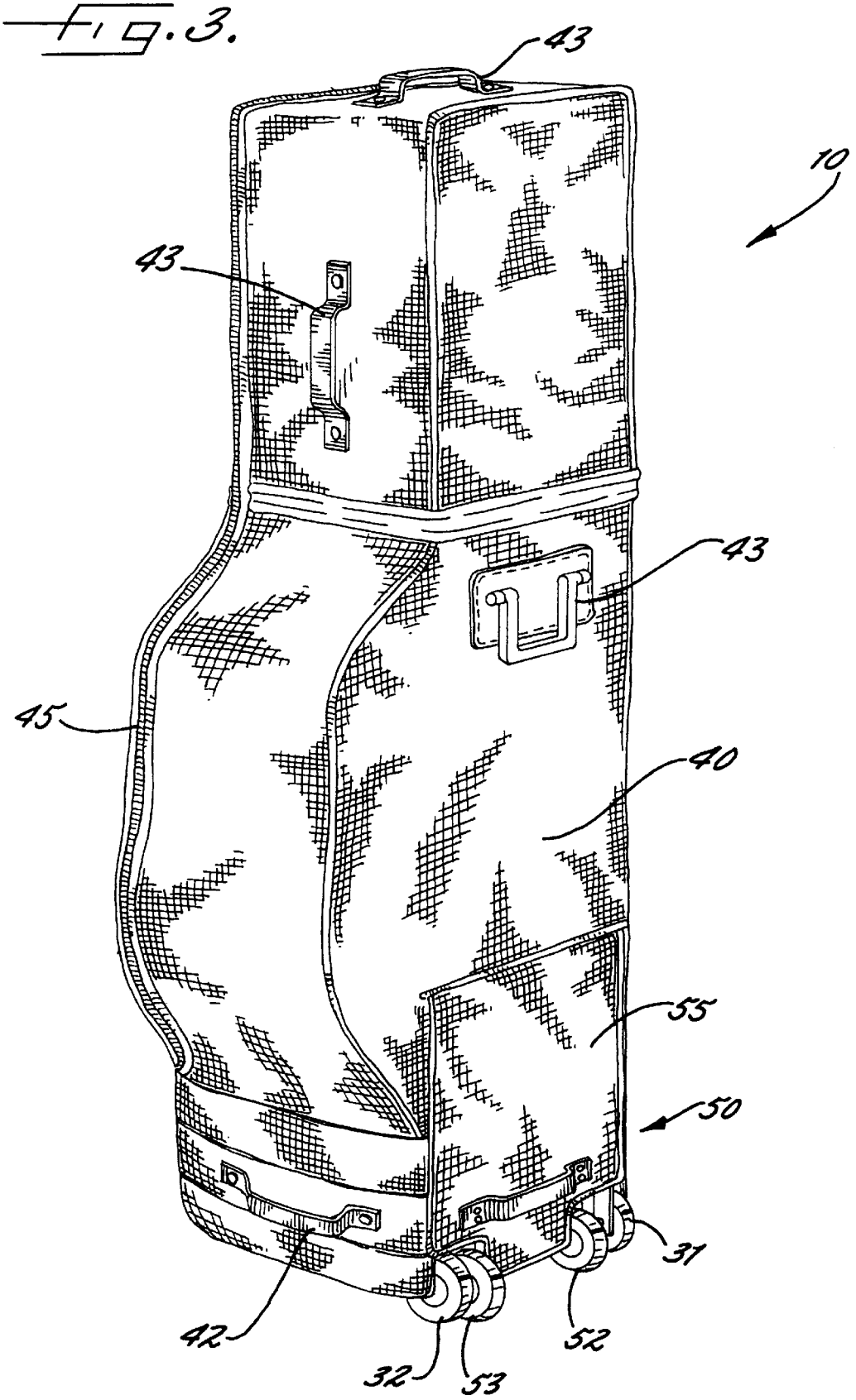
FIG. 3 is a rear perspective view of a recreational equipment luggage transport system having an auxiliary transport apparatus shown in a retracted position according to the present invention.
Figure 4:
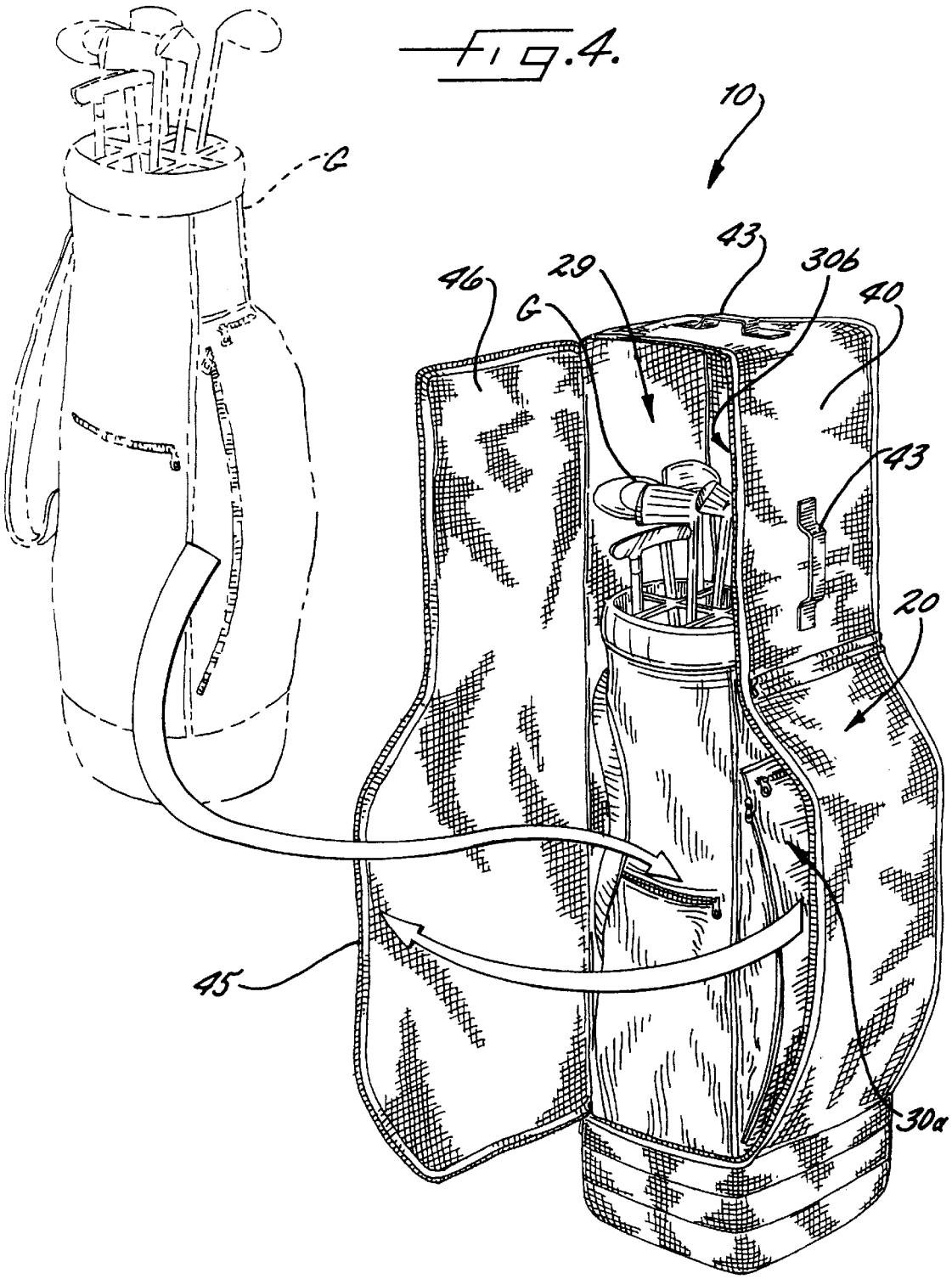
FIG. 4 is a front perspective view of a recreational equipment luggage transport system having a front cover in an open position and having a set of golf clubs in a bag positioned therein according to the present invention.

As perhaps best illustrated in FIGS. 2–3 and 8, the main piece 20 of luggage also preferably has an auxiliary transport apparatus 50 pivotally connected to the main luggage frame 21. The auxiliary transport apparatus 50 is positioned to be extended to a first engaged position and retracted to a second different storage position (see FIGS. 2–3). The auxiliary transport apparatus 50 preferably includes an auxiliary frame 51, a plurality of auxiliary wheel members 52, 53 connected thereto, and an auxiliary cover member 55 connected to and extending outwardly from a lower rearward portion of the cover 40 of the main piece 20 of luggage and connected to the auxiliary frame 51 so that when the auxiliary transport apparatus 50 is positioned in the retracted storage position the auxiliary frame 51 is substantially hidden from ready viewing by the auxiliary cover member 55. At least one of the auxiliary cover member 55 and the cover 40 of the main piece 20 of luggage have a fastener 59, e.g., preferably provided by a plurality of mating hooks and a plurality of mating loops, but can also be mating snaps or other types as understood by those skilled in the art, connected thereto for fastening the auxiliary cover member 55 to the cover 40 only when the auxiliary transport apparatus 50 is positioned in the retracted position. The plurality of auxiliary wheel members 52, 53 provide a more balanced support to such large loads as recreational equipment, also preferably extend to a higher elevation along the main luggage frame 21 than the wheel member(s) 31, 32 of the main luggage frame 21 when the auxiliary transport apparatus 50 is positioned in the retracted storage position.

Figures 5, 6:
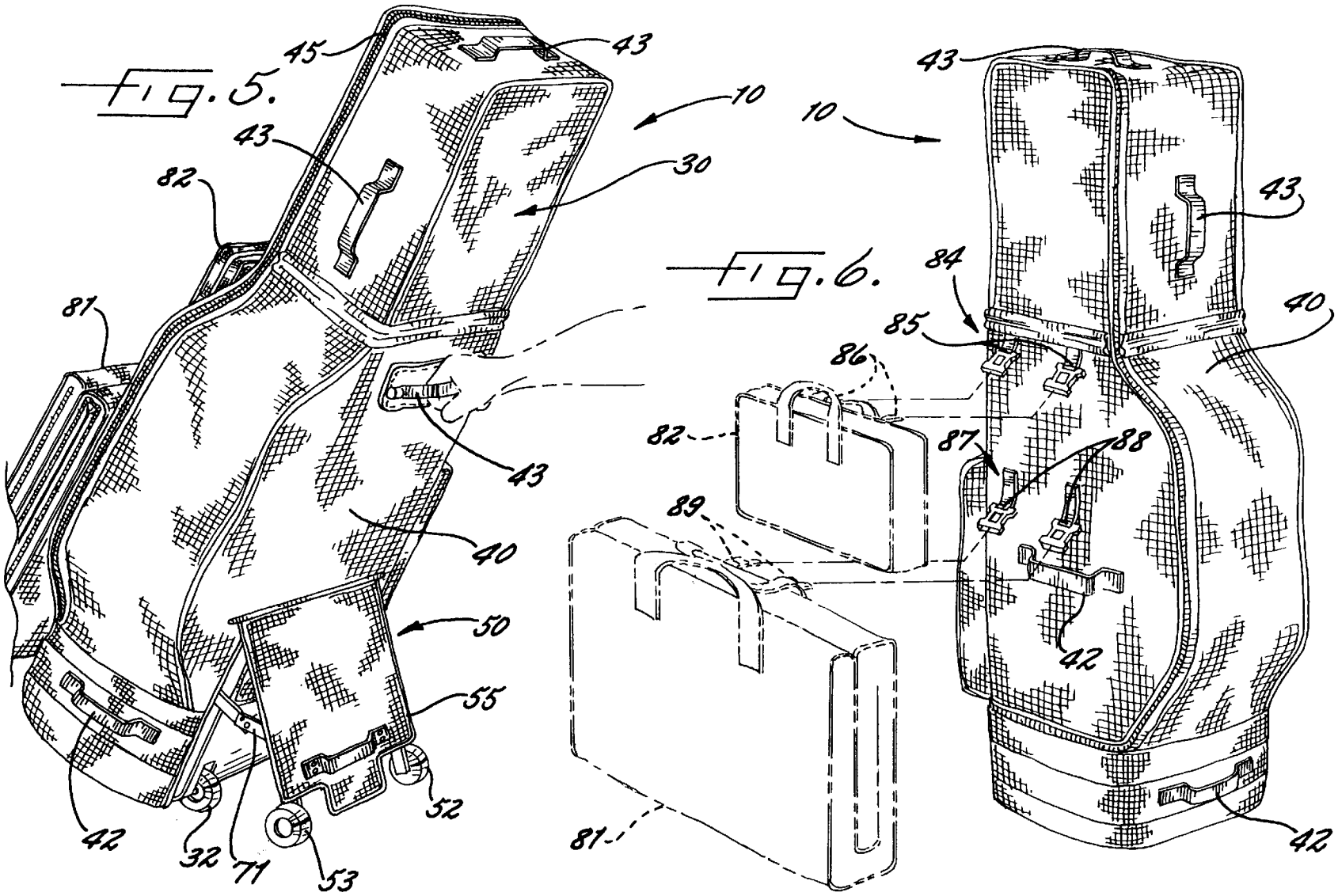
FIG. 5 is a rear perspective view of a recreational equipment luggage transport system showing the towing thereof from a rear handle according to the present invention.
FIG. 6 is a front perspective view of a recreational equipment luggage transport system showing the connection of additional pieces of luggage thereto in broken lines to thereby illustrate the carrying of additional luggage therewith according to the present invention.
Figure 9:
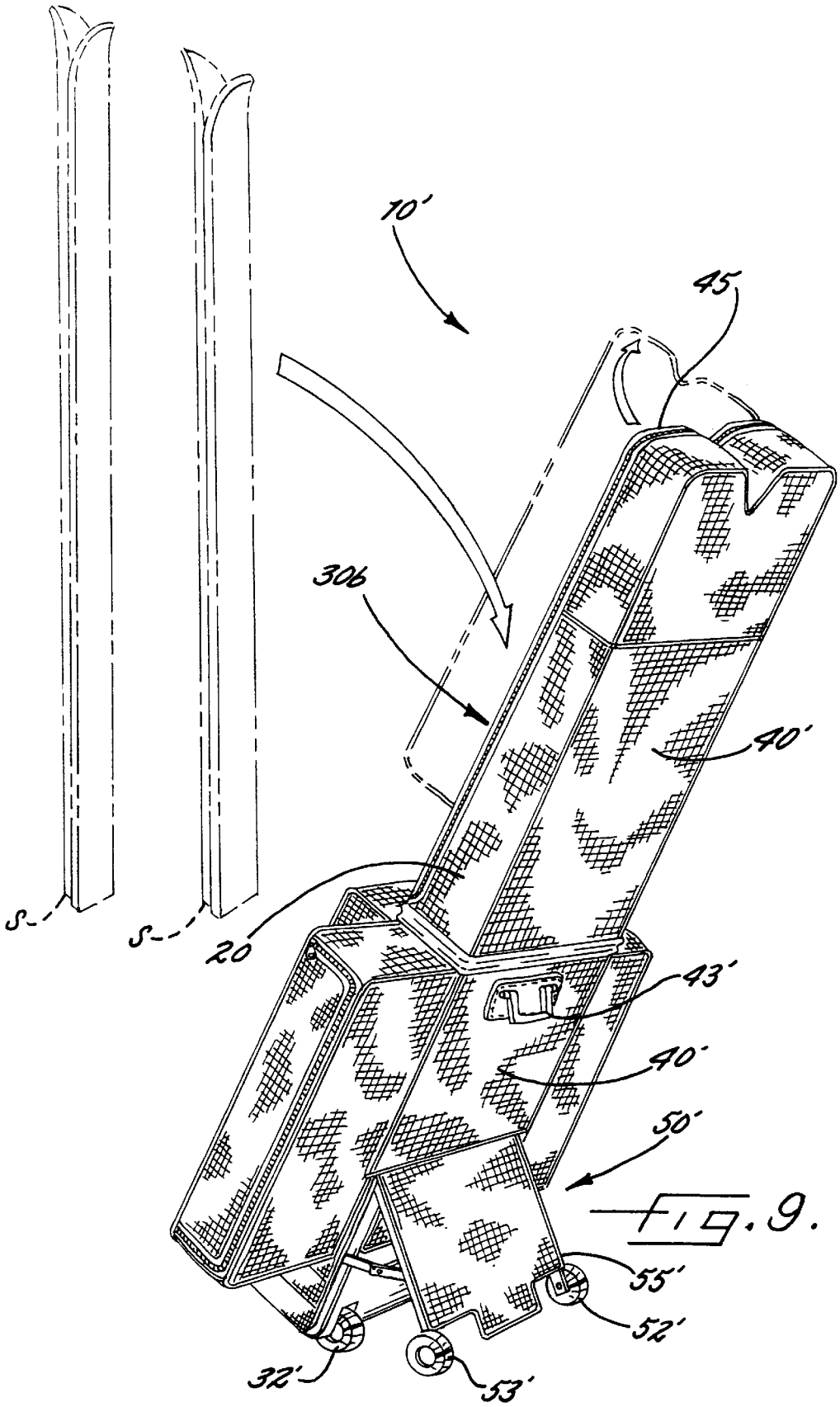
FIG. 9 is an alternative embodiment of a rear perspective view of a recreational equipment luggage transport system for skis according to the present invention.

As perhaps best illustrated in FIGS. 5 and 8–9, the auxiliary frame 51 of the auxiliary transport apparatus 50 is preferably positioned to be connected to a frame 21 of a wheeled device such as the main piece 20 of luggage which carries the recreational equipment. The auxiliary frame 51 preferably has an auxiliary frame facing member 60 positioned to be pivotally connected to the main luggage frame 21 and to extend outwardly therefrom and at least one pair of spaced-apart auxiliary frame arms 71, 76 positioned to be connected to the main luggage frame 21 and the auxiliary frame facing member 60 and is pivotally movable between a retracted storage position and an extended engaged position. Each arm 71, 76 of the at least one pair of spaced-apart auxiliary frame arms 71, 76 includes a first arm portion 72, 77 connected to the auxiliary frame facing member 60 and extending inwardly therefrom, a second arm portion 73, 78 positioned to be connected to the main luggage frame 21 and extending outwardly therefrom and pivotally connected to the first arm portion 72, 77, and at least one arm retainer portion 74, 79 associated with the first and second arm portions 72, 73, 77, 78 for engagingly retaining the first and second arm portions 72, 73, 77, 78 in the extended engaged position. Each of the pair of auxiliary frame arms 71, 76 are preferably connected to the lower auxiliary frame mounting member 35 of the main luggage frame 21 of the main piece 20 of luggage.

The auxiliary frame facing member 60 preferably has a substantially rectangular shape and includes upper and lower spaced-apart elongate frame portions 61, 62 longitudinally extending substantially parallel to each other and a pair of spaced-apart elongate side frame portions 63, 64 each transversely connected to the upper and lower spaced-apart elongate frame portions 61, 62 and extending substantially parallel to each other. A respective one of each of the at least one pair of spaced-apart auxiliary frame arms 71, 76 is connected to a medial portion of a respective one of the pair of spaced-apart elongate side frame portions 63, 64. The apparatus 50 also has a plurality of auxiliary wheel members 52, 53 connected to a lower end portion of the auxiliary frame 51. An auxiliary suspension rod 68 is also transversely connected to and suspending between the pair of auxiliary frame arms 71, 76 for providing suspension support to the pair of auxiliary frame arms 71, 76.

As illustrated in FIGS. 1 and 5–6, the system 10 also has a plurality of pieces of additional luggage 81, 82 connected to the cover 40 of the main piece 20 of recreational equipment storage luggage. The plurality of pieces of additional luggage 81, 82 advantageously include one or more of the following: a garment bag, a briefcase, and a computer bag. The additional pieces, however, can also be tote bags, clothing luggage, cosmetic bags, various travel kits, or other luggage as understood by those skilled in the art. The cover 40 and each of the plurality of additional pieces of luggage 81, 82 include a plurality of mating fasteners 84, 87 connected thereto. At least one mating fastener portion 85 of the plurality of mating fasteners 84, 87 is connected to the cover 40 on an opposite surface of the cover 40 from a surface of the cover 40 from which the auxiliary transport apparatus 50 extends. The opposite surface defines a front surface and the surface from which the auxiliary transport apparatus 50 extends defines a rear surface. At least one of the additional pieces of luggage 84, 87 is matingly fastened to the at least one mating fastener portion 85 of the cover 40 to thereby supportingly carry and transport the at least one piece of additional luggage with the enlarged main piece 20 of luggage connected thereto. The at least one mating fastener portion 85 of the front surface of the cover 40 includes a plurality of mating fastening portions 85, 86, 88, 89, and wherein the plurality of pieces of additional luggage 81, 82 includes a first piece of additional luggage 81 fastened to a lower portion of the front surface and a second piece 82 of additional luggage fastened to a medial portion of the front surface. In other words, one piece of luggage 82 is positioned at a higher elevation than another piece of luggage 81.

As illustrated in FIGS. 1–9, the present invention also advantageously includes a method of transporting large recreational equipment G, S. The method preferably includes the step of positioning large recreational equipment G within a main storage body cavity 29 of an enlarged main piece 20 of recreational equipment storage luggage. The main piece 20 of luggage has a main luggage frame 21 positioned along a rearward end thereof and has at least one wheel member 31, 32 connected to a lower end portion of the main luggage frame 21. The method also preferably includes the step of extending an auxiliary transport apparatus 50 outwardly from the main luggage frame 21. The auxiliary transport apparatus 50 includes an auxiliary frame 51 and at least one auxiliary wheel member 52, 53 connected to the auxiliary frame 51. The method further includes the step of towing the main piece 20 of luggage so that the at least one wheel member 31, 32 thereof and the at least one auxiliary wheel member 52, 53 abuttingly contact the same support surface when being towed.

The method can also advantageously include the large recreational equipment having a longitudinal extent substantially longer than a standard adult size tennis racket. The main piece 20 of luggage can advantageously include a fixed position tow handle 43 connected to an upper portion of the main piece 20 of luggage, and the towing step including engaging the tow handle 43 with the hand of a user U. The method can additionally include adjustably positioning the auxiliary transport apparatus 50 in a balanced position with respect to the weight distribution of the large recreational equipment G positioned within the main storage body cavity 29 of the main piece 20 of luggage and connecting at least one additional piece 81, 82 of luggage to a front surface of the main piece 20 of luggage prior to the step of towing the main piece 20 of luggage so that the main piece 20 of luggage and the additional piece 81, 82 of luggage are towed together.

The method further can include connecting a plurality of additional pieces 81, 82 of luggage to a front surface of the main piece 20 of luggage. At least a first one 82 of the plurality of additional pieces 81, 82 of luggage is preferably connected at a higher elevation on the front surface than a second one 81 of the plurality of additional pieces 81, 82 of luggage. The main piece 20 of luggage includes a cover 40 encasing the main body cavity 29, and the auxiliary transport apparatus 50 further includes an auxiliary cover 55 fixedly connected to and extending outwardly from the cover 40 of the main piece 20 of luggage and connected to the auxiliary frame 51 when the auxiliary transport apparatus 50 is in the extended engaged position. Another portion of the auxiliary cover 55 also is detachably connected to the cover 40 of the main piece 20 of luggage when in the retracted storage position. The method can also disconnecting the auxiliary cover 55 from the cover 40 of the main piece 20 of luggage prior to the step of extending the auxiliary transport apparatus 50 outwardly from the main luggage frame 21.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of the appended claims.

That which is claimed:

1. A recreational equipment luggage transport system for transporting recreational equipment, the system comprising:

an enlarged main piece of recreational equipment storage luggage having enlarged recreational equipment positioned therein, the enlarged recreational equipment having a longitudinal extent substantially longer than a standard adult size tennis racket, said main piece including a main luggage frame, at least one wheel member connected to a lower end portion of said main luggage frame, a cover connected to said frame and being sized to position large recreational equipment therein, and an auxiliary transport apparatus pivotally connected to said main luggage frame, said auxiliary transport apparatus positioned to be pivotally extended to a first engaged position and pivotally retracted to a second different storage position and including an auxiliary frame and a plurality of auxiliary wheel members connected thereto; and at least one piece of additional luggage connected to said enlarged main piece of recreational equipment storage luggage, a cover member substantially covering said auxiliary transport apparatus.

2. A system as defined in claim 1, wherein said enlarged main piece of recreational equipment storage luggage is shaped to easily receive an adult size set of golf clubs positioned in an adult size golf bag, and wherein the enlarged recreational equipment includes adult size golf clubs positioned in an adult size golf bag.

3. A system as defined in claim 1, wherein said enlarged main piece of recreational equipment storage luggage is shaped to easily receive at least one pair of adult size skis, and wherein the enlarged recreational equipment includes at least one pair of adult size skis.

4. A system as defined in claim 1, wherein said enlarged main piece of recreational equipment storage luggage includes a main storage body cavity, said main storage body cavity including a first lower portion extending along a lower portion of said main luggage frame and a second upper portion contiguous with said first lower portion and extending along an upper portion of said main luggage frame, said first lower portion being substantially larger than said first upper portion to receive a substantially larger portion of the mass positioned in said main storage body cavity, and wherein said auxiliary transport apparatus is connected to the lower portion of said main luggage frame for enhancing stability of transporting the system having a substantially larger portion of the mass positioned in said main storage body cavity.

5. A system as defined in claim 4, wherein said cover of said enlarged main piece of recreational equipment storage luggage has at least one tow handle connected to an upper portion thereof to enhance towing of the system when the auxiliary transport apparatus is positioned in the extended and engaged position.

6. A system as defined in claim 1, wherein the at least one piece of additional luggage comprises a plurality of pieces of additional luggage, said plurality of pieces of additional luggage including one or more of the following: a garment bag, a briefcase, and a computer bag.

7. A system as defined in claim 6, wherein said cover and each of said plurality of additional pieces of luggage include a plurality of mating fasteners connected thereto, at least one mating fastener portion of said plurality of mating fasteners connected to said cover being connected to an opposite surface of said cover from a surface of said cover from which said auxiliary transport apparatus extends, the opposite surface defining a front surface and the surface from which said auxiliary transport apparatus extends defining a rear surface, and wherein at least one of said additional pieces of luggage are matingly fastened to said at least one mating fastener portion of said cover to thereby supportingly carry and transport said at least one piece of additional luggage with said enlarged main piece of luggage connected thereto.

8. A system as defined in claim 7, wherein said at least one mating fastener portion of the front surface of said cover includes a plurality of mating fastening portions, and wherein said plurality of pieces of additional luggage includes a first piece of additional luggage fastened to a lower portion of the front surface and a second piece of additional luggage fastened to a medial portion of the front surface.

9. A system as defined in claim 1, wherein said main luggage frame of said enlarged main piece of recreational equipment storage luggage includes a lower base frame member positioned along a lower most portion of said enlarged main piece of recreational equipment storage luggage, wherein said at least one wheel member is connected to a rearwardly extending portion of said lower base frame member, and wherein said enlarged main piece of recreational equipment storage luggage further includes at least one foot member extending downwardly from a forwardly extending portion of said lower base frame member.

10. A system as defined in claim 9, wherein said lower base frame member includes a first plate portion extending substantially parallel to a support surface when said at least one foot member and said at least one wheel member abuttingly contact said support surface and a second plate portion connected to said first plate portion along a common edge thereof and extending upwardly therefrom so as to define a substantially L-shape plate member, and wherein said cover has at least one lifting handle connected thereto and overlying a lower portion of said body cavity.

11. A system as defined in claim 9, wherein said main luggage frame further includes an upper frame member, a pair of spaced-apart and substantially parallel tubular members interconnecting said upper frame member and said lower base frame member and maintaining said upper frame member and said lower base member in a predetermined spaced-apart relation so as to define said main body cavity therebetween, said cover being connected to said upper frame member and said lower base member and enclosing said main body cavity, said cover having an openable fastener thereon for providing access to the interior of said main body cavity.

12. A system as defined in claim 11, wherein said main luggage frame further includes tubular member engaging means connected to said pair of spaced-apart tubular members and connected to said auxiliary frame for supportingly engaging said pair of tubular members.

13. A system as defined in claim 12, wherein said tubular member engaging means includes a pair of frame mounts each having a mount body and an annular shaped opening extending therethrough, said annular shaped opening being positioned to receive one of said pair of tubular members therethrough.

14. A system as defined in claim 1, wherein said auxiliary cover member connected to a lower rearward portion of said cover of said enlarged main piece of recreational equipment storage luggage and to said auxiliary frame so that when said auxiliary transport apparatus is positioned in the retracted storage position said auxiliary frame is substantially hidden from ready viewing.

15. A system as defined in claim 14, wherein at least one of said auxiliary cover member and said cover have a fastener connected thereto for fastening said auxiliary cover member to said cover only when said auxiliary transport apparatus is positioned in the retracted position.

16. A system as defined in claim 14, wherein said plurality of auxiliary wheel members extend to a higher elevation along said main luggage frame than said at least one wheel member when said auxiliary transport apparatus is positioned in the retracted storage position.

17. A system as defined in claim 12, wherein said auxiliary frame includes an auxiliary frame facing member pivotally connected to said main luggage frame and extending outwardly therefrom and at least one pair of spaced-apart auxiliary frame arms connected to said main luggage frame and said auxiliary frame facing member and being movably positioned between the retracted storage position and the extended engaged position.

18. A system as defined in claim 17, wherein each arm of said at least one pair of spaced-apart auxiliary frame arms includes a first arm portion connected to said auxiliary frame facing member and extending inwardly therefrom, a second arm portion connected to said main luggage from and extending outwardly therefrom and pivotally connected to said first arm portion, and at least one arm lock portion associated with said first and second arm portions for engagingly locking said first and second arm portions in the extended engaged position.

19. A system as defined in claim 18, wherein said auxiliary frame facing member has a substantially rectangular shape, includes upper and lower spaced-apart elongate frame portions longitudinally extending substantially parallel to each other and a pair of spaced-apart elongate side frame portions each transversely connected to the upper and lower spaced-apart elongate frame portions and extending substantially parallel to each other, said upper frame portion being connected to said tubular member engaging means, a respective one of each of said at least one pair of spaced-apart auxiliary frame arms being connected to a medial portion of a respective one of said pair of spaced-apart elongate side frame portions.

20. A system as defined in claim 18, wherein said auxiliary frame further includes an auxiliary frame suspension rod transversely connected to and suspending between said pair of auxiliary frame arms for providing suspension support to said pair of auxiliary arms, and wherein said main luggage frame further includes a lower auxiliary frame mounting member transversely connected to lower portions of said pair of tubular members, each of said pair of auxiliary frame arms being connected to said lower auxiliary frame mounting member.

21. A recreational equipment luggage transport system for transporting recreational equipment, the system comprising:

a main piece of recreational equipment storage luggage, said main piece including a main luggage frame at least having a lower base frame member, an upper frame member, and a pair of spaced-apart and substantially parallel tubular members interconnecting said upper frame member and said lower base frame member and maintaining said upper frame member and said lower base member in a predetermined spaced-apart relation so as to define a main body cavity therebetween for positioning recreational equipment therein, at least one wheel member connected to a rearwardly extending portion of said lower base frame member, at least one foot member extending downwardly from a forwardly extending portion of said lower base frame member, a cover connected to said upper frame member and said lower base member and enclosing said main body cavity, said cover having an openable fastener thereon for providing access to the interior of said main body cavity , and an auxiliary transport apparatus pivotally connected to said main luggage frame, said auxiliary transport apparatus positioned to be extended to a first engaged position and retracted to a second different storage position and including an auxiliary frame and a plurality of auxiliary wheel members connected thereto; and a plurality of pieces of additional luggage connected to said cover of said main piece of recreational equipment storage luggage, said cover and each of said plurality of additional pieces of luggage including a plurality of mating fasteners connected thereto, at least one mating fastener portion of said plurality of mating fasteners connected to said cover being connected to an opposite surface of said cover from a surface of said cover from which said auxiliary transport apparatus extends, the opposite surface defining a front surface and the surface from which said auxiliary transport apparatus extends defining a rear surface, at least one of said additional pieces of luggage being matingly fastened to said at least one mating fastener portion of said cover to thereby supportingly carry and transport said at least one piece of additional luggage with said enlarged main piece of luggage connected thereto, a cover member substantially covering said auxiliary transport apparatus.

22. A system as defined in claim 21, wherein said main piece of recreational equipment storage luggage is shaped to easily receive an adult size set of golf clubs positioned in an adult size golf bag.

23. A system as defined in claim 21, wherein said main piece of recreational equipment storage luggage is shaped to easily receive at least one pair of adult size snow skis.

24. A system as defined in claim 21, wherein said main storage body cavity includes a first lower portion extending along a lower portion of said main luggage frame and a second upper portion contiguous with said first lower portion and extending along an upper portion of said main luggage frame, said first lower portion being substantially larger than said first upper portion to receive a substantially larger portion of the mass positioned in said main storage body cavity, and wherein said auxiliary transport apparatus is connected to the lower portion of said main luggage frame for enhancing stability of transporting the system having a substantially larger portion of the mass positioned in said main storage body cavity.

25. A system as defined in claim 24, wherein said cover of said main piece of recreational equipment storage luggage has at least one tow handle connected to an upper portion thereof to enhance towing of the system when the auxiliary transport apparatus is positioned in the extended and engaged position.

26. A system as defined in claim 21, wherein said plurality of pieces of additional luggage include one or more of the following: a garment bag, a briefcase, and a computer bag.

27. A system as defined in claim 26, wherein said cover is openable by said openable fastener along a front cover thereof, said openable fastener extending along at least two of the peripheral edges of the front cover.

28. A system as defined in claim 27, wherein said at least one mating fastener portion of the front surface of said cover includes a plurality of mating fastening portions, and wherein said plurality of pieces of additional luggage includes a first piece of additional luggage fastened to a lower portion of the front surface and a second piece of additional luggage fastened to a medial portion of the front surface.

29. A system as defined in claim 21, wherein said lower base frame member includes a first plate portion extending substantially parallel to a support surface when said at least one foot member and said at least one wheel member abuttingly contact said support surface and a second plate portion connected to said first plate portion along a common edge thereof and extending upwardly therefrom so as to define a substantially L-shape plate member, and wherein said cover has at least one lifting handle connected thereto and overlying a lower portion of said body cavity.

30. A system as defined in claim 29, wherein said main luggage frame further includes tubular member engaging means connected to said pair of spaced-apart tubular members and connected to said auxiliary frame for supportingly engaging said pair of tubular members.

31. A system as defined in claim 30, wherein said tubular member engaging means includes a pair of frame mounts each having a mount body and an annular shaped opening extending therethrough, said annular shaped opening being positioned to receive one of said pair of tubular members therethrough.

32. A system as defined in claim 29, wherein said auxiliary cover member connected to a lower rearward portion of said cover of said enlarged main piece of recreational equipment storage luggage and to said auxiliary frame so that when said auxiliary transport apparatus is positioned in the retracted storage position said auxiliary frame is substantially hidden from ready viewing.

33. A system as defined in claim 32, wherein at least one of said auxiliary cover member and said cover have a fastener connected thereto for fastening said auxiliary cover member to said cover only when said auxiliary transport apparatus is positioned in the retracted position.

34. A system as defined in claim 32, wherein said plurality of auxiliary wheel members extend to a higher elevation along said main luggage frame than said at least one wheel member when said auxiliary transport apparatus is positioned in the retracted storage position.

35. A system as defined in claim 30, wherein said auxiliary frame includes an auxiliary frame facing member pivotally connected to said main luggage frame and extending outwardly therefrom and at least one pair of spaced-apart auxiliary frame arms connected to said main luggage frame and said auxiliary frame facing member and being movably positioned between the retracted storage position and the extended engaged position.

36. A system as defined in claim 35, wherein each arm of said at least one pair of spaced-apart auxiliary frame arms includes a first arm portion connected to said auxiliary frame facing member and extending inwardly therefrom, a second arm portion connected to said main luggage from and extending outwardly therefrom and pivotally connected to said first arm portion, and at least one arm lock portion associated with said first and second arm portions for engagingly locking said first and second arm portions in the extended engaged position.

37. A system as defined in claim 36, wherein said auxiliary frame facing member has a substantially rectangular shape, includes upper and lower spaced-apart elongate frame portions longitudinally extending substantially parallel to each other and a pair of spaced-apart elongate side frame portions each transversely connected to the upper and lower spaced-apart elongate frame portions and extending substantially parallel to each other, said upper frame portion being connected to said tubular member engaging means, a respective one of each of said at least one pair of spaced-apart auxiliary frame arms being connected to a medial portion of a respective one of said pair of spaced-apart elongate side frame portions.

38. A system as defined in claim 36, wherein said auxiliary frame further includes an auxiliary frame suspension rod transversely connected to and suspending between said pair of auxiliary frame arms for providing suspension support to said pair of auxiliary arms, and wherein said main luggage frame further includes a lower auxiliary frame mounting member transversely connected to lower portions of said pair of tubular members, each of said pair of auxiliary frame arms being connected to said lower auxiliary frame mounting member.

39. A luggage transport system comprising:

a main piece of luggage including a main luggage frame, said main luggage frame a pair of spaced-apart and substantially parallel tubular members interconnecting upper and lower portions of said main luggage frame, at least one wheel member connected to a lower end portion of said main luggage frame, a cover connected to said frame, and an auxiliary transport apparatus pivotally connected to said main luggage frame, said auxiliary transport apparatus positioned to be extended to a first engaged position and retracted to a second different storage position and including an auxiliary frame, a plurality of auxiliary wheel members connected thereto, and an auxiliary cover member connected to and extending outwardly from a lower rearward portion of said cover of said main piece of luggage and connected to said auxiliary frame so that when said auxiliary transport apparatus is positioned in the retracted storage position said auxiliary frame is substantially hidden from ready viewing by said auxiliary cover member.

40. A system as defined in claim 39, further comprising at least one piece of additional luggage connected to said cover of said main piece of luggage, and wherein said main piece of luggage is enlarged and shaped to easily receive an adult size set of golf clubs positioned in an adult size golf bag.

41. A system as defined in claim 39, wherein said main piece of luggage is enlarged and shaped to easily receive at least one pair of adult size snow skis.

42. A system as defined in claim 39, wherein said main piece of luggage includes a main storage body cavity, said main storage body cavity including a first lower portion extending along a lower portion of said main luggage frame and a second upper portion contiguous with said first lower portion and extending along an upper portion of said main luggage frame, said first lower portion being substantially larger than said first upper portion to receive a substantially larger portion of the mass positioned in said main storage body cavity, and wherein said auxiliary transport apparatus is connected to the lower portion of said main luggage frame for enhancing stability of transporting the system having a substantially larger portion of the mass positioned in said main storage body cavity.

43. A system as defined in claim 42, wherein said cover of said main piece of luggage has at least one tow handle connected to an upper portion thereof to enhance towing of the system when the auxiliary transport apparatus is positioned in the extended and engaged position.

44. A system as defined in claim 39, wherein the at least one piece of additional luggage comprises a plurality of pieces of additional luggage, said plurality of pieces of additional luggage including one or more of the following: a garment bag, a briefcase, and a computer bag.

45. A system as defined in claim 44, wherein said cover and each of said plurality of additional pieces of luggage include a plurality of mating fasteners connected thereto, at least one mating fastener portion of said plurality of mating fasteners connected to said cover being connected to an opposite surface of said cover from a surface of said cover from which said auxiliary transport apparatus extends, the opposite surface defining a front surface and the surface from which said auxiliary transport apparatus extends defining a rear surface, and wherein at least one of said additional pieces of luggage are matingly fastened to said at least one mating fastener portion of said cover to thereby supportingly carry and transport said at least one piece of additional luggage with said enlarged main piece of luggage connected thereto.

46. A system as defined in claim 45, wherein said at least one mating fastener portion of the front surface of said cover includes a plurality of mating fastening portions, and wherein said plurality of pieces of additional luggage includes a first piece of additional luggage fastened to a lower portion of the front surface and a second piece of additional luggage fastened to a medial portion of the front surface.

47. A system as defined in claim 39, wherein said main luggage frame of said main piece of luggage includes a lower base frame member positioned along a lower most portion of said main piece of luggage, wherein said at least one wheel member is connected to a rearwardly extending portion of said lower base frame member, and wherein said enlarged main piece of recreational equipment storage luggage further includes at least one foot member extending downwardly from a forwardly extending portion of said lower base frame member.

48. A system as defined in claim 47, wherein said lower base frame member includes a first plate portion extending substantially parallel to a support surface when said at least one foot member and said at least one wheel member abuttingly contact said support surface and a second plate portion connected to said first plate portion along a common edge thereof and extending upwardly therefrom so as to define a substantially L-shape plate member, and wherein said cover has at least one lifting handle connected thereto and overlying a lower portion of said body cavity.

49. A system as defined in claim 47, wherein said main luggage frame further includes an upper frame member, a pair of spaced-apart and substantially parallel tubular member interconnecting said upper frame member and said lower base frame member and maintaining said upper frame member and said lower base member in a predetermined spaced apart relation so as to define said main body cavity therebetween, said cover being connected to said upper frame member and said lower base member and enclosing said main body cavity, said cover having an openable fastener thereon for providing access to the interior of said main body cavity.

50. A system as defined in claim 49, wherein said main luggage frame further includes tubular member engaging means connected to said pair of spaced-apart tubular members and connected to said auxiliary frame for supportingly engaging said pair of tubular members.

51. A system as defined in claim 50, wherein said tubular member engaging means includes a pair of frame mounts each having a mount body and an annular shaped opening extending therethrough, said annular shaped opening being positioned to receive one of said pair of tubular members therethrough.

52. A system as defined in claim 39, wherein said auxiliary transport apparatus further includes an auxiliary cover member connected to a lower rearward portion of said cover of said enlarged main piece of recreational equipment storage luggage and to said auxiliary frame so that when said auxiliary transport apparatus is positioned in the retracted storage position said auxiliary frame is substantially hidden from ready viewing.

53. A system as defined in claim 52, wherein at least one of said auxiliary cover member and said cover have a fastener connected thereto for fastening said auxiliary cover member to said cover only when said auxiliary transport apparatus is positioned in the retracted position.

54. A system as defined in claim 52, wherein said plurality of auxiliary wheel members extend to a higher elevation along said main luggage frame than said at least one wheel member when said auxiliary transport apparatus is positioned in the retracted storage position.

55. A system as defined in claim 50, wherein said auxiliary frame includes an auxiliary frame facing member pivotally connected to said main luggage frame and extending outwardly therefrom and at least one pair of spaced-apart auxiliary frame arms connected to said main luggage frame and said auxiliary frame facing member and being movably positioned between the retracted storage position and the extended engaged position.

56. A system as defined in claim 55, wherein each arm of said at least one pair of spaced-apart auxiliary frame arms includes a first arm portion connected to said auxiliary frame facing member and extending inwardly therefrom, a second arm portion connected to said main luggage from and extending outwardly therefrom and pivotally connected to said first arm portion, and at least one arm lock portion associated with said first and second arm portions for engagingly locking said first and second arm portions in the extended engaged position.

57. A system as defined in claim 56, wherein said auxiliary frame facing member has a substantially rectangular shape, includes upper and lower spaced-apart elongate frame portions longitudinally extending substantially parallel to each other and a pair of spaced-apart elongate side frame portions each transversely connected to the upper and lower spaced-apart elongate frame portions and extending substantially parallel to each other, said upper frame portion being connected to said tubular member engaging means, a respective one of each of said at least one pair of spaced-apart auxiliary frame arms being connected to a medial portion of a respective one of said pair of spaced-apart elongate side frame portions.

58. A system as defined in claim 56, wherein said auxiliary frame further includes an auxiliary frame suspension rod transversely connected to and suspending between said pair of auxiliary frame arms for providing suspension support to said pair of auxiliary arms, and wherein said main luggage frame further includes a lower auxiliary frame mounting member transversely connected to lower portions of said pair of tubular members, each of said pair of auxiliary frame arms being connected to said lower auxiliary frame mounting member.

59. An auxiliary transport apparatus in combination with a wheeled device, said apparatus comprising:

an auxiliary frame positioned to be connected to a frame of the wheeled device and including an auxiliary frame facing member positioned to be pivotally connected to the frame of the wheeled device and to extend outwardly therefrom, at least one pair of spaced-apart auxiliary frame arms positioned to be connected to the frame of the wheeled device and said auxiliary frame facing member and being movably positioned between a retracted storage position and an extended engaged position, each arm of said at least one pair of spaced-apart auxiliary frame arms including a first arm portion connected to said auxiliary frame facing member and extending inwardly therefrom, a second arm portion positioned to be connected to the frame of the wheeled device and extend outwardly therefrom and pivotally connected to said first arm portion, and at least one arm lock portion associated with said first and second arm portions for engagingly locking said first and second arm portions in the extended engaged position, said auxiliary frame facing member having a substantially rectangular shape, including upper and lower spaced-apart elongate frame portions longitudinally extending substantially parallel to each other and a pair of spaced-apart elongate side frame portions each transversely connected to the upper and lower spaced-apart elongate frame portions and extending substantially parallel to each other, a respective one of each of said at least one pair of spaced-apart auxiliary frame arms being connected to a medial portion of a respective one of said pair of spaced-apart elongate side frame portions; and a plurality of auxiliary wheel members connected to a lower end portion of said auxiliary frame the wheeled device includes a cover, and the apparatus further comprises an auxiliary cover member connected to and extending outwardly from a lower rearward portion of the cover of the wheeled device and connected to said auxiliary frame so that when said auxiliary transport apparatus is positioned in the retracted storage position said auxiliary frame is substantially hidden from ready viewing by said auxiliary cover member.

60. The combination as defined in claim 59, wherein said auxiliary frame further includes an auxiliary frame suspension rod transversely connected to and suspending between said pair of auxiliary frame arms for providing suspension support to said pair of auxiliary arms.

61. The combination as defined in claim 59, wherein said plurality of auxiliary wheel members extend to a higher elevation along a frame of the wheeled device than one or more wheel members positioned at a lower end portion of the wheeled device when said auxiliary transport apparatus is positioned in the retracted storage position.

62. A method of transporting large recreational equipment, the method comprising the steps of:

positioning large recreational equipment having a longitudinal extend substantially longer than a standard adult size tennis racket within a main storage body cavity of an enlarged main piece of recreational equipment storage luggage, the main piece of luggage having a main luggage frame positioned along a rearward end thereof and having at least one wheel member connected to a lower end portion of the main luggage frame, a cover connected to said frame and being sized to position large recreational equipment therein;

extending an auxiliary transport apparatus outwardly from the main luggage frame, the auxiliary transport apparatus including an auxiliary frame and at least one auxiliary wheel member connected to the auxiliary frame providing at least one piece of additional luggage to said enlarged main piece; and towing the main piece of luggage so that the at least one wheel member thereof and the at least one auxiliary wheel member abuttingly contact the same support surface when being towed.

63. A method as defined in claim 62, wherein the main piece of luggage includes a fixed position tow handle connected to an upper portion of the main piece of luggage, and wherein the towing step includes engaging the tow handle with the hand of a user.

64. A method as defined in claim 63, further comprising connecting a plurality of additional pieces of luggage to a front surface of the main piece of luggage, at least a first one of the plurality of additional pieces of luggage being connected at a higher elevation on the front surface than a second one of the plurality of additional pieces of luggage.

65. A method as defined in claim 62, further comprising the step of adjustably positioning the auxiliary transport apparatus in a balanced position with respect to the weight distribution of the large recreational equipment positioned within the main storage body cavity of the main piece of luggage.

66. A method as defined in claim 62, further comprising connecting said at least one additional piece of luggage to a front surface of the main piece of luggage prior to the step of towing the main piece of luggage so that the main piece of luggage and the additional piece of luggage are towed together.

67. A method as defined in claim 62, wherein said auxiliary transport apparatus further includes an auxiliary cover fixedly connected to and extending outwardly from the cover of the main piece of luggage and connected to the auxiliary frame when the auxiliary transport apparatus is in the extended engaged position, another portion of the auxiliary cover also being detachably connected to the cover of the main piece of luggage when in the retracted storage position.

68. A method as defined in claim 67, further comprising disconnecting the auxiliary cover from the cover of the main piece of luggage prior to the step of extending the auxiliary transport apparatus outwardly from the main luggage frame.

* * * * *

UNITED STATES PATENT AND TRADEMARK OFFICE

CERTIFICATE OF CORRECTION

PATENT NO. : 6,164,425
DATED : DECEMBER 26, 2000
INVENTOR(S) : LATSHAW

It is certified that error appears in the above-identified patent and that said Letters Patent is hereby corrected as shown below:

| | |
|---|---|
| Column 11, Claim 18, line 59 | Strike "from" and Insert - -frame- - therefor. |
| Column 14, Claim 36, line 23 | Strike "from" and Insert - -frame- - therefor. |
| Column 16, Claim 56, line 62 | Strike "from" and Insert - -frame- - therefor. |

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*